United States Patent [19]

Nierhaus

[11] Patent Number: 5,031,240

[45] Date of Patent: Jul. 16, 1991

[54] KNEEPAD

[75] Inventor: Wolfgang Nierhaus, Bad Salzuflen, Fed. Rep. of Germany

[73] Assignee: Friedr. Nierhaus & Co., Bad Salzuflen, Fed. Rep. of Germany

[21] Appl. No.: 494,111

[22] Filed: Mar. 14, 1990

[51] Int. Cl.[5] ..... A41D 13/06

[52] U.S. Cl. ..... 2/24; 2/62; 128/80 C

[58] Field of Search ..... 2/24, 62; 128/80 C

[56] References Cited

U.S. PATENT DOCUMENTS

| | | | |
|---|---|---|---|
| 1,452,360 | 4/1923 | Clarke | 2/24 |
| 1,486,308 | 3/1924 | Shook | 2/24 |
| 1,666,846 | 4/1928 | Cooper | 2/24 |
| 4,068,312 | 1/1978 | Ledesma | 2/24 |

*Primary Examiner*—Werner H. Schroeder

*Assistant Examiner*—Gloria Hale

*Attorney, Agent, or Firm*—Robert W. Becker

[57] ABSTRACT

A kneepad having a lower, substantially cylindrical portion for resting against the shinbone of a user, an upper partly spherical portion for resting against a kneecap of a user, and a retaining strap connected to lateral edges of the lower portion for extending about a leg of a user. The retaining strap is connected in the vicinity of a lower edge of the lower portion remote from the upper portion. From the side, the upper portion has the shape of an arc. The upper region of the upper portion, remote from the lower portion, is formed by folds that extend over approximately half of the arc. The upper portion also has a lower region interposed between the upper region thereof and the lower portion. This lower region has no folds and has essentially the same construction as the lower portion.

7 Claims, 1 Drawing Sheet

KNEEPAD

BACKGROUND OF THE INVENTION

The present invention relates to a kneepad having a lower portion that substantially has the shape of part of a cylinder, with the lower portion being intended for resting against the upper part of a shinbone of a user, with the kneepad also having an upper portion that is in the shape of part of a sphere, with the upper portion being intended for resting against a kneecap of a user, and with the kneepad further having a retaining strap that is connected to lateral edges of the lower portion and in use extends about a leg of a user.

With heretofore known kneepads of this type there is the danger that the retaining strap will assume a position in the bend or hollow of the knee, either already when the kneepad is put on, or during use thereof. Such a position of the retaining strap is uncomfortable; during longer periods of use, this position of the retaining strap can even be painful.

It is therefore an object of the present invention to provide a kneepad of the aforementioned general type that is comfortable to wear, whereby the retaining strap cannot cause pain in the bend of the knee, whereby the knee of the user is largely surrounded and protected, and whereby a lateral protection of the knee in the region of the bend thereof is also provided in order to prevent foreign objects from entering the bend of the knee.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
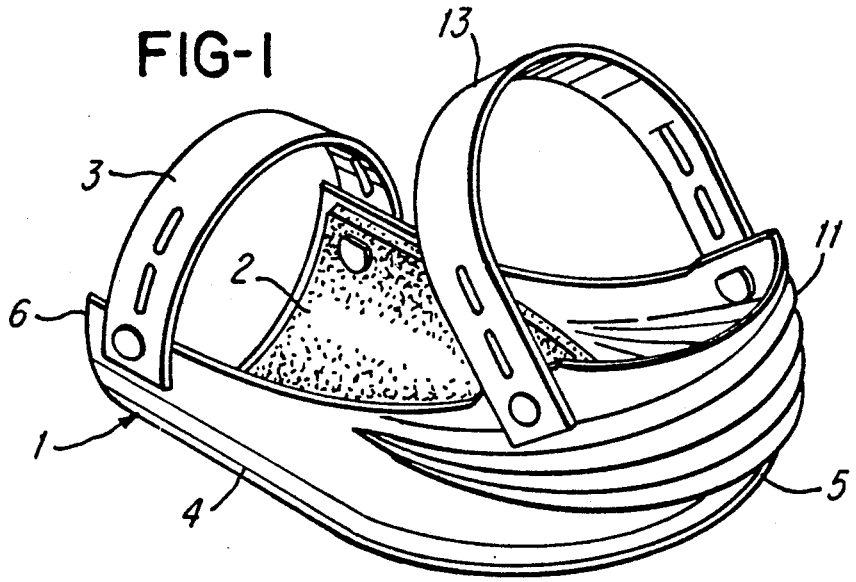
FIG. 1 is a diagrammatic view of one exemplary embodiment of the inventive kneepad.

The kneepad of the present invention is characterized primarily in that: the retaining strap is connected to the lower portion in the vicinity of a lower edge thereof remote from the upper portion; the upper portion, when viewed from the side, substantially has the shape of an arc as defined by the spherical shape, with the upper portion further having an upper region, remote from the lower portion, that is formed by folds that extend over approximately half of the arc, and with the upper portion also having a lower region that is interposed between the upper region of the upper portion and the lower portion, with the lower region of the upper portion having no folds and having essentially the same construction as the lower portion.

Of particular significance with the inventive configuration is that the retaining strap is connected way at the bottom to lateral edges of the lower, cylindrical portion, and hence extends about the leg a sufficient distance below the bend of the knee. The inventive kneepad cannot shift and slide, even when the leg is first bent during use of the kneepad, is again extended when the user stands up, and is then again bent when the user again kneels on the ground or floor, because the upper region of the spherical portion is very movable and deformable as a consequence of the folds, so that during the aforementioned movements of the leg, no notable longitudinal forces are introduced into the kneecap that could cause a shifting thereof.

As indicated above, the folds increase the deformability of the kneepad. The folds adapt to the knee of the user without causing pressure points or sores to be formed even during prolonged use. Since in addition the folds extend a long way downwardly into the cylindrical portion, these folds also ensure that the lateral parts of the knee are effectively protected. In particular, the bend of the knee is also protected at the sides in order to preclude the effect of foreign objects and mechanical effects.

The folds preferably extend approximately over half the length of the cylindrical portion. In addition, the folds also extend over half of the spherical portion (when viewed from the side), whereas that part of the spherical portion that directly adjoins the cylindrical portion is comprised of fold-free, relatively hard or solid rubber, plastic, or the like. In other words, with regard to strength and thickness, this part of the spherical portion is made of the same material and has the same thickness a does the cylindrical portion.

Further specific features of the present invention will be described in detail subsequently.

DESCRIPTION OF PREFERRED EMBODIMENTS

Referring now to the drawing in detail, the kneepad essentially comprises a relatively solid or hard shell 1, of rubber, plastic, or the like, that is intended for contact with the ground or floor. The shell 1 is at least partially lined with a padding 2. The kneepad is held in position by means of a retaining strap 3.

The shell 1, as well as the padding 2, the configuration of which is adapted to the shape of the shell, have a lower portion 4 that has the shape of part of a cylinder. Adjoining the upper end of the portion 4 is a portion 5 that has the shape of part of a sphere. The portions 4 and 5 merge into one another along the imaginary dashed line 6'.

Figure 2:
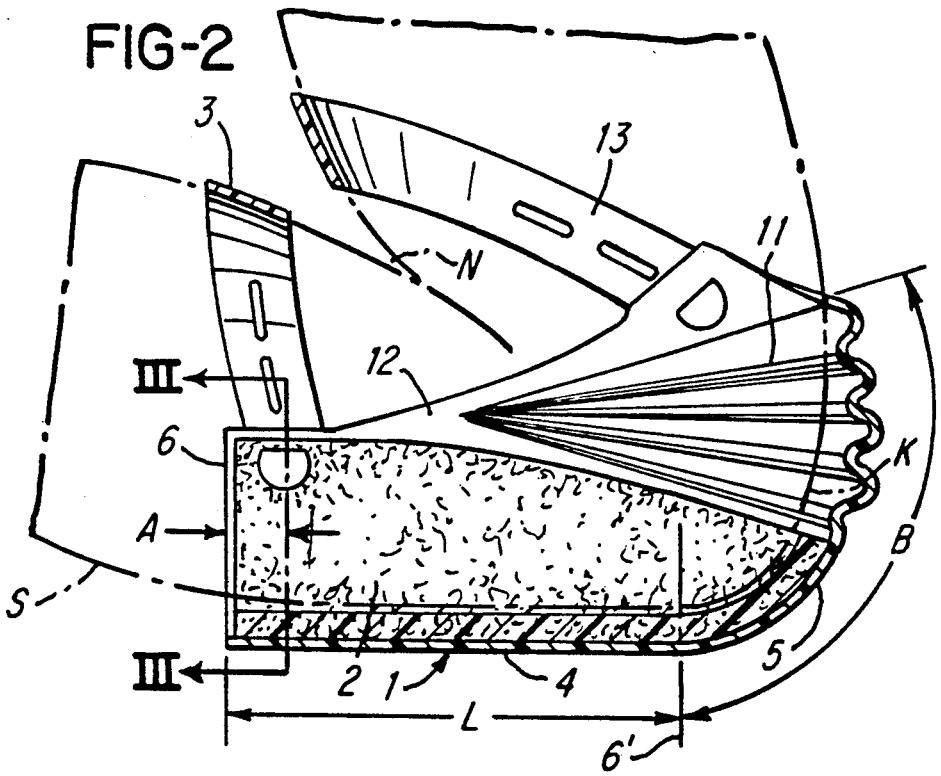
FIG. 2 is a longitudinal cross-sectional view through the kneepad of FIG. 1 in a position of use.
Figure 3:
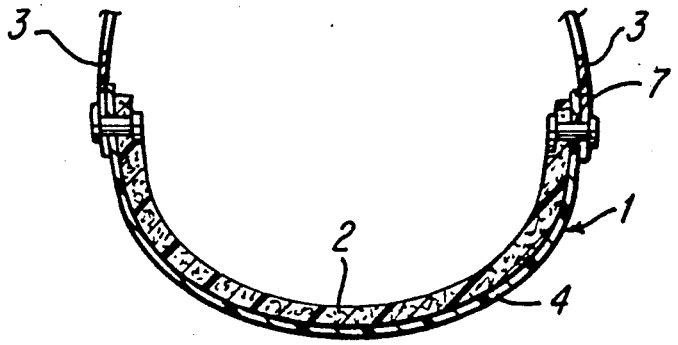
FIG. 3 is a cross-sectional view taken along the line III—III in FIG. 2.

As can be seen from FIG. 2, in a position of use the portion 4 of the kneepad rests against the shinbone S of the user; the knee K of the user contacts the portion 5. Disposed at the lower end of the portion 4 are securement hole 7 (FIG. 3) for the retaining strap 3, which can be adjustable in any suitable manner. As a consequence of this arrangement of the retaining strap 3 remote from the portion 5 and near the lower edge 6 of the kneepad, the retaining strap 3 extends around the leg of the user just below the bend or hollow N of the knee. In this connection, the ratio of the distance A to the length L should be approximately 1:5 to 1:3.

The greatest part of the portion 5, which faces the free edge, is formed from cleats or folds 11 that extend toward the rear, with the width thereof decreasing in this direction (see FIG. 2). The folds 11 end approximately halfway along the length L of the portion 4, where they merge into virtually fold-free, sheet-like portions 12; the depth (amplitude) of the folds 11 therefore decreases to the same extent that the fold width (wavelength) decreases.

Since the folds 11 extend over only approximately half the length of the arc B that is defined by the spherical portion 5, a lower arc portion is consequently provided that has the same construction as the portion 4 and is capable of adequately absorbing the forces that are produced at the knee K.

The upper edge region of the portion 5 is connected to a further retaining strap 13; this retaining strap could be omitted, but is advantageous if the folds 11 are particularly soft and hence do not have a permanent or stable shape.

The folds 11, together with the portion 12, largely protect the sides of the knee of the wearer. In so doing, the bend N of the knee is also protected from the entry of foreign objects. In addition, in conjunction with the non-folded part of the portion 5, the folds 11 also provide a sufficiently reliable support when in contact with the ground or floor.

It should be noted that although the retaining straps 3 and 13 have been illustrated as being attached via securement holes 7 and studs or the like, any other suitable means, such as a Velcrotype fastener, snaps, etc., can be utilized to secure the retaining straps to the kneepad in such a way that the retaining straps can be adjusted.

The present invention is, of course, in no way restricted to the specific disclosure of the specification and drawing, but also encompasses any modifications within the scope of the appended claims.

What I claim is:

1. In a kneepad having a lower portion that substantially has the shape of part of a cylinder, with said lower portion being intended for resting against the upper part of a shinbone of a user, with said kneepad also having an upper portion that is in the shape of part of a sphere, with said upper portion being intended essentially for resting against a kneecap of a user, and with said kneepad further having a retaining strap that is connected to lateral edges of said lower portion and in use extends about a leg of a user, the improvement wherein:

said retaining strap is connected in the vicinity of a lower edge of said lower portion remote from said upper portion; and said upper portion, when viewed from the side, substantially has the shape of an arc, as defined by said spherical shape, with said upper portion further having an upper region, remote from said lower portion, that is formed by folds that extend over approximately half of said arc, and with said upper portion also having a lower region that is interposed between said upper region thereof and said lower portion, with said lower region of said upper portion having no folds and having essentially the same construction as said lower portion.

2. A kneepad according to claim 1, in which said folds extend in a direction toward said lower portion, whereby above said lower portion said folds merge into a solid-walled sheet-like portion that has an approximately triangular shape.

3. A kneepad according to claim 2, in which said sheet-like portion ends at approximately half the length of said lower portion.

4. A kneepad according to claim 1, in which said folds end at approximately half the length of said lower portion.

5. A kneepad according to claim 1, in which said folds decrease in width and height in a direction toward said lower portion.

6. A kneepad according to claim 1, in which a further retaining strap is connected to said upper region of said upper portion.

7. A kneepad according to claim 1, in which said upper region of said upper portion that is formed by folds is deformable.

* * * * *